US005590675A

United States Patent [19]

Babb

[11] Patent Number: 5,590,675

[45] Date of Patent: Jan. 7, 1997

[54] ANTI-SIPHON VALVE

[76] Inventor: Matthew T. Babb, 2244 S. Santa Fe Ave., Unit A6, Vista, Calif. 92084

[21] Appl. No.: 396,129

[22] Filed: Feb. 28, 1995

[51] Int. Cl.[6] ..... F17D 1/14; B67D 5/40

[52] U.S. Cl. ..... 137/14; 137/565; 417/279; 417/300

[58] Field of Search ..... 417/279, 300; 137/565, 14

[56] References Cited

U.S. PATENT DOCUMENTS 2,795,238 6/1957 Hirsch ..... 417/300
3,183,839 5/1965 Brunson et al. ..... 417/300
3,547,559 12/1970 Tittmann ..... 417/300
3,663,126 5/1972 Langosch ..... 417/300
3,723,025 3/1973 Coakley ..... 417/300

*Primary Examiner*—A. Michael Chambers
*Attorney, Agent, or Firm*—John J. Murphey, Esq.; Murphey Law Offices

[57] ABSTRACT

A method of valving a flow of pumped fluid, to prevent siphoning of the flow when the pump is stopped, including the steps of filling a chamber with fluid, directing a small flow of pumped fluid into the chamber to increase its volume, opening a main flow valve by the increase in chamber volume, providing a leak in the chamber to reduce the volume of fluid therein when the small flow of pumped fluid is terminated, and closing the main flow valve by the decrease in chamber volume.

21 Claims, 2 Drawing Sheets

ANTI-SIPHON VALVE

BACKGROUND OF THE INVENTION

1. Field of the Invention

This invention pertains to the field of valves and valve actuators. More particularly, this invention pertains to a valve for positioning between a source of fluid, such as an above-ground fuel tank, and a transfer pump, used to pump the fluid to a destination, such as to a vehicle fuel tank, the valve operating to open when the pump is turned on and to close when the pump is turned off to prevent a continuation of flow due to siphoning.

2. Description of the Prior Art

In delivering liquids, such as fuels, from underground tanks to an above-ground destination, the transfer pump starts with a negative head and must draw the liquid upward before pumping it to the destination, such as into an automobile fuel tank. When the transfer pump is shut off, the flow of fuel in the transfer line immediately ceases due to the gravitational pull on the liquid. Recent environmental protection legislation calls for the fuel to be stored in above-ground tanks. This has shifted the static hydraulic situation from a negative head to a positive static head against the transfer pump. Gravity actually aids in this situation in the transfer of liquid by providing a positive pressure on the intake side of the transfer pump. A danger exists, however, in that the fuel will continue to flow by siphon action after the pump is turned off. This will cause the fuel to flow through the pump even after the pump is motionless thereby creating a fire or explosion hazard. Older pumps that draw fuel from underground tanks cannot be used to pump fuel from above-ground tanks without extensive reworking.

An electric shut-off valve could be used to open and close the transfer line when power is applied and then cut off to the pump. This is expensive, however, because of all the safe guards required to prevent the electricity from causing a fire or explosion in the fuel that has leaked from the pump. Accordingly, the prior art has not been able to develop a mechanically-operated valve having sufficient reliability to inhibit siphon flow that satisfies the demands of the fuel industry.

SUMMARY OF THE INVENTION

This invention is a hydraulically-actuated, shut-off or anti-siphon valve for placement in the transfer line of above-ground tanks from which the fluid contents are pumped to a destination. It does not use electricity but is operated by a small quantity of fuel from the high pressure side or output of the transfer pump. The valve "senses" the beginning of the pumping operation and opens and remains open throughout the entire pumping operation and then closes positively as soon as power to the pump is cut off. This valve is unique in that it may be inserted anywhere in the fluid transfer line and will work properly regardless of its orientation, i.e., whether placed in an upright, sideways or upside down position. Its operation is independent of static fluid pressure on the valve. The valve requires priming only the first time it is used and thereafter operates whether or not the transfer line is filled with fluid.

This invention is based upon a method whereby an expandable chamber controls the opening of the valve; this expansion is derived in the difference between fluid flowing into and out of the chamber along separate paths. During pumping action there is more fluid pumped into the chamber than leaks out of the chamber so that the size or volume of the chamber is made to expand and open the transfer line valve. Upon cessation of pump action, the ratio of fluid-flow in the chamber is reversed, with more fluid leaking out of the chamber than coming into it, so that the chamber contracts to drive the valve closed. As long as the pump remains off, the valve remains closed and prohibits any flow through the transfer line by siphon action or any other means.

The valve of this invention has few parts and the action of these parts is confined to a small range of movement so as to prolong the life of the valve. The parts are strong in design and resist abuse that is generally encountered in out door industrial usage. The valve operates over a wide temperature range and under all weather conditions. All valve motion is confined to the interior of the valve within a thick metal shell with no external movement so that the valve may be mounted in tight places and yet function properly. The valve is self-actuating, once primed, so that it may be installed by a person of limited ability and yet function properly. Its main function is to prevent loss of fuel to the environment thereby saving the earth's resources and reducing the threat of ground pollution.

Accordingly, the main object of this invention is a flow shut-off valve for use in the transfer of liquids to prevent after-flow due to siphoning action. Other objects include a valve that shuts off the flow of liquid in a transfer line when the transfer pump is shut off; a valve that shuts off the flow of fluid therethrough regardless of the static head applied to the valve; a valve whose action is controlled by the relationship between separate flows of fluid into and out of an expandable chamber; a valve having few moving parts that are housed in a rugged design and that will function without regard to exterior temperature, humidity, or other environmental conditions, regardless of physical orientation and location; and, a valve whose operation may be obtained by those possessing limited skill.

These and other objects of the invention will become more apparent upon reading the following description of the preferred embodiment taken together with the drawings appended hereto. The scope of protection sought by the inventor may be gleaned from a fair reading of the claims that conclude this specification.

DESCRIPTION OF THE PREFERRED EMBODIMENT

Figure 1:
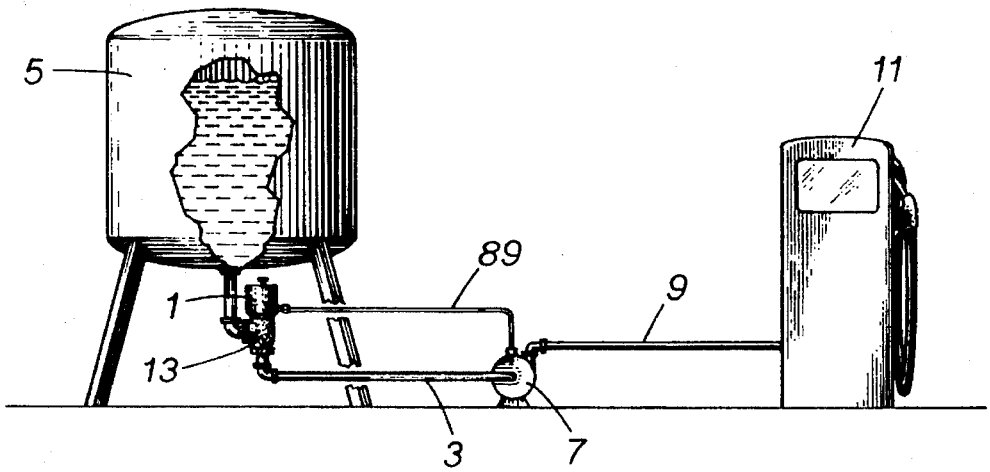
FIG. 1 is a schematic view of the tank, valve, pump and destination arrangement where this valve finds use.

Turning now to the drawings, wherein like elements are identified with like numerals throughout the seven figures, FIG. 1 shows, in schematic, the placement of the valve 1 of this invention in a fuel transfer line 3 that extends between an above-ground tank 5 and a transfer pump 7 whose output line 9 feeds a metering station 11 for transferring fuel into the fuel tank of a motor vehicle (not shown). The location of the tank and the volume of fuel located above ground provides a static head to the intake side of pump 7.

Figure 2:
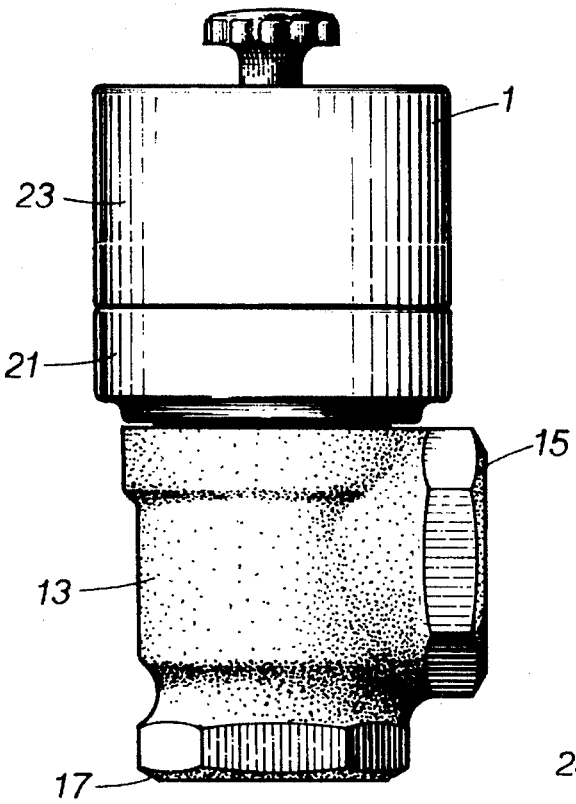
FIG. 2 is a side elevational view of the preferred embodiment of this invention.
Figure 3:
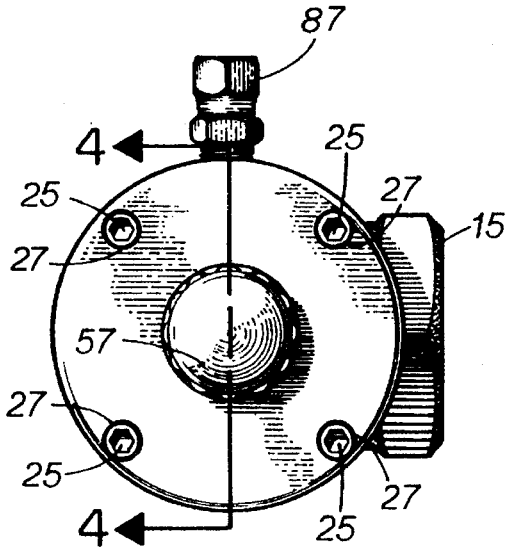
FIG. 3 is a top view of the embodiment shown in FIG. 2.

FIG. 2 depicts the overall construction of valve 1 and shows a valve casting 13 having a pipe-threaded inlet 15 and pipe-threaded outlet 17 normal thereto. While inlet 15 and outlet 17 may be interchanged, in the preferred embodiment inlet 15 is located at the side of casting 3 while outlet 17 is located at the bottom thereof. When used in this configuration, the valve resists opening under pressure of the static head of the fuel regardless of its pressure. A valve base 21 is fixed atop valve casting 13 and is covered over by a valve body 23 in sealed engagement therewith. As shown in FIG. 3, valve base 21 and valve body 23 are cylindrical and valve body 23 is fastened down onto valve base 21 by a plurality of long bolts 25 received in bores 27, formed in valve body 23, and that extend into threaded bores (not shown) formed in valve base 21.

Figure 4:
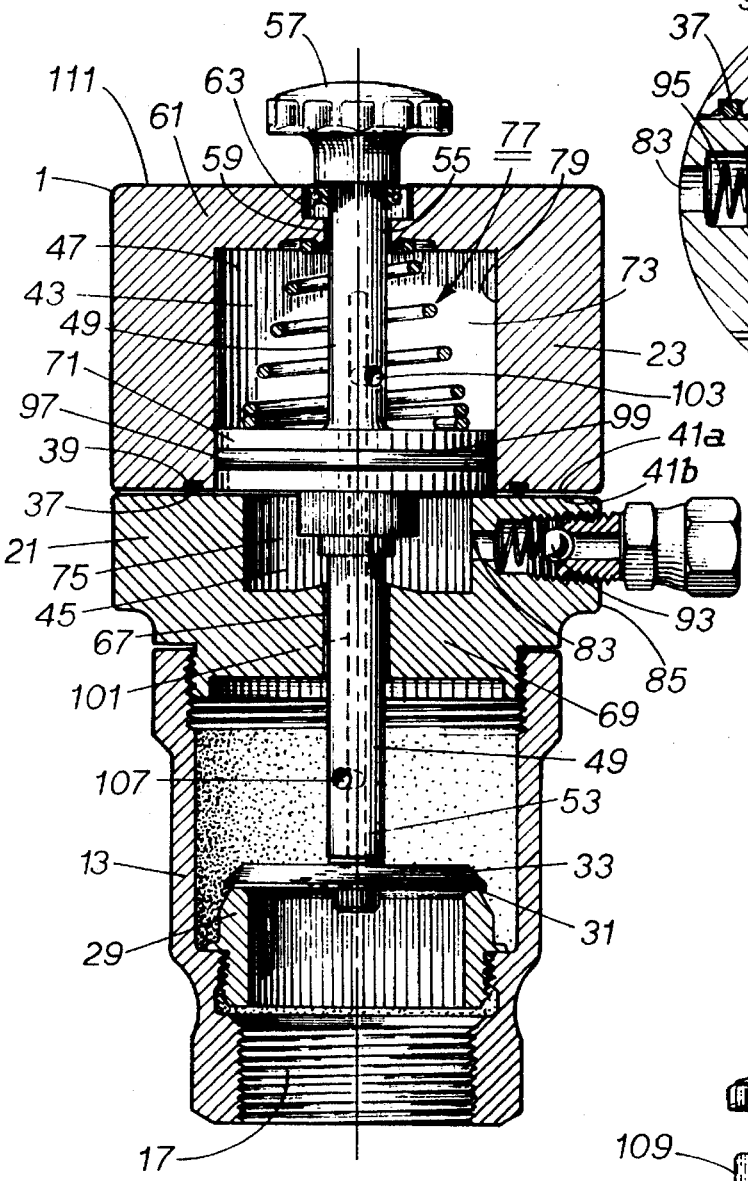
FIG. 4 is a side, elevational and sectional view of the embodiment shown in FIG. 2 taken along lines 4—4 in FIG. 3.

FIG. 4 shows the layout of valve parts in the preferred embodiment of this invention and shows an annular valve seat 29 mounted in threaded engagement interior of valve casting 13 and axially aligned with valve outlet 17. A flat valve surface 31 is formed on the upper portion of valve seat 29. A circular valve seal 33 is concentrically mounted for reciprocal motion above valve seat 29 and has a flat surface machined thereunder for full concentric mating with valve surface 31 of valve seat 29 to effect a total shut off of fluid flow therethrough.

An O-ring 37 is housed in a groove 39 formed in one of the mating surfaces 41*a* or 41*b* of valve body 23 or valve base 21 to seal the junction therebetween. A cylindrical enclosure 43 is formed centrally in valve body 23 and valve base 21, in axial alignment with valve outlet 17, wherein the inside diameter of the lower portion 45 of enclosure 43 is smaller than the inside diameter of the upper portion 47 of enclosure 43. A rod 49 is positioned along the central axis of valve 1 having a lower distal end 53 attached to valve seal 33 and an upper distal end 55 attached to a knob 57 located exterior to valve 1. The upper portion of rod 49 passes through a close-fitting aperture 59 formed in the upper wall portion 61 of valve body 23 and surrounded by an oil seal 63 to prevent leakage of liquid from enclosure 43. The lower portion of rod 49 passes through a loose-fitting aperture or bore 67 formed in the lower wall portion 69 of valve base 21. It is preferred that this looseness be carefully controlled, such as an annular diameter of 0.005 inches greater than the diameter of rod 49 passing therethrough. This provides one of the paths for fluid flow out of enclosure 43 as will be further explained.

A piston 71 is located on rod 49 intermediate upper and lower valve wall portions 61 and 69, respectively, and rides against the smooth cylindrical inner walls of enclosure 43, to divide enclosure 43 into an upper chamber 73 and a lower chamber 75. Rod 49 and piston 71 can alternatively be considered as a "controller" to open and close valve 1 as will more fully explained. A biasing means 77, such as the coiled spring shown in FIG. 4, is mounted concentric to rod 49 and interposed piston 71 and upper valve wall portion 61 to place a downward bias or pressure on piston 71. Preferably, piston 71 is arranged to bottom against valve base mating surface 41*b*, or some other stop, when valve seal 33 is brought into full, closing contact with valve surface 31 when valve 1 is closed.

Figure 5:
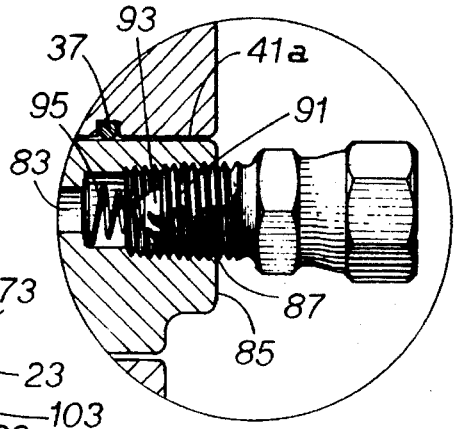
FIG. 5 is a close-up view of the check valve located in the side wall of the valve.

A bore 83 is formed through cylindrical wall 85 of valve base 21 and, as shown in FIG. 5, contains a threaded portion for the receipt thereof of a pipe fitting 87 to which is connected a small-diameter sensing line 89 that is connected at its other end to the output side of transfer pump 7. Preferably, a check valve 91, comprising a check ball 93, adapted to seat against a ring (not shown) for cutting off return flow of liquid, and a valve spring 95, is mounted inboard of pipe fitting 87 and arranged to allow the flow of a small quantity of high-pressure liquid, from pump 7, into lower chamber 75 while preventing back flow therethrough. An O-ring 97 is fastened in a groove 99 about the outer circumferential surface of piston 71 to bear against the cylindrical walls of enclosure 43 and prevent the passage or leakage of fluid thereacross. A central passageway 101 is formed interior of rod 49 having an entry port 103 located above piston 71 and an exit port 107 located below piston 71 and preferably near valve seal 33.

The method of operation of valve 1 is as follows: Lower chamber 75 is filled with fluid (primed). Transfer pump 7 is turned on and a small flow of fluid from the high-pressure side of said pump is pumped through sensing line 89 and check valve 91 into lower chamber 75. Fluid begins leaking out of chamber 75 down through aperture or bore 67 into valve casting 13. The relative flow or ratio of flows of fluid into chamber 75, through bore 83, and out of chamber 75, through aperture 67, is such that more fluid flows in than out and lower chamber 75 increases in volume thereby driving piston 71 upward. Piston rod 49 rises upward, along with piston 71, and raises valve seal 33 off of valve surface 31 and valve seat 29 thereby opening valve 1 and allowing fluid to pass from tank 5 through valve casting 13 to pump 7 and over to metering station 11. Piston 71 rises against the bias pressure of means 77 and comes to rest at some point above mating surface 41*b* (or other stop) when the pressure of expansion of lower chamber 75 equals the downward pressure of means 77. Preferably, means 77 is designed to allow full expansion of lower chamber 75 at 5–10 psig pressure in sensing line 89 so that means 77 is fully collapsed and piston 71 rises almost to the top of chamber 73.

When the power to pump 7 is terminated and pump 7 stops pumping, the flow of the small quantity of fluid through sensing line 89 ceases. The ratio of flows into and out of lower chamber 75 reverses or reverts to mathematical zero because the flow through sensing line 89 becomes zero. Leakage of fluid from lower chamber 75 through aperture 67 continues, however, allowing lower chamber 75 to shrink in volume. As lower chamber 75 shrinks, biasing means 77 forces piston 71 downward pushing rod 49 downward and forcing valve seal 33 against valve surface 31 on valve seat 29 and closing valve 1. The spring constant of biasing connector 77 is adjusted, by means known in the art, to force piston 71 downward when fluid in lower chamber 75 leaks through aperture 67 into valve casting 13, yet be overcome by the fluid-flow through sensing line 89 allowing the expanding volume of fluid in lower chamber 75 to force piston 71 in an upward motion. Valve 1 will thereafter remain closed, shutting off all flow through transfer line 3, whether by siphoning action or otherwise, until pump 7 is again turned on. When piston 71 butts against valve base mating surface 41*b* (or some other stop) its downward travel is stopped. Valve 1 is fully closed and chamber 75 ceases shrinking. Air cannot get into chamber 75 because piston 71 is sealed by O-ring 97. Air will not pass, under atmospheric pressure, through aperture 67 because of its small size and of the viscosity of the fluid.

Figure 7:
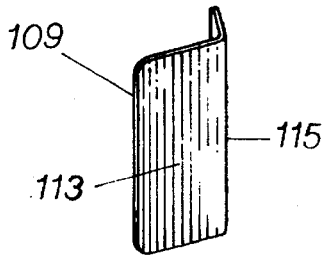
Figure 6:
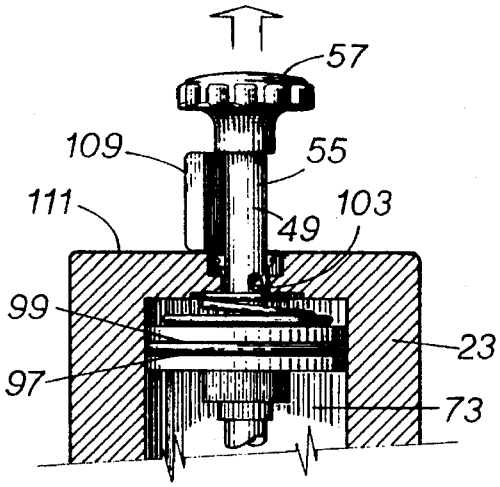
FIG. 6 is an illustrative view of the valve in its configuration when being primed; and, FIG. 7 is a trimetric view of the preferred embodiment of the priming pin of this invention.

In order for valve 1 to operate properly, it must be primed during its first cycle to drive air out of chamber 75. This is conveniently performed, as shown in FIG. 6, by manually pulling upward on knob 57 to pull piston 71 upward thereby mechanically opening valve 1. As shown in FIG. 7, a priming pin 109, comprising a small panel 113, folded along a line 115, is set upright between knob 57 and the top surface 111 of valve body 23 to hold piston 71 in a raised position. Pressurized fluid-flow through sensing line 89 will drive air trapped in lower chamber 75 down through aperture 67 and into valve casting 13 so as to eliminate air from expandable lower chamber 75. Should any fluid work its way into upper chamber 73, it finds a free exit in through entry port 103, down central passageway 101, and out exit port 107 into valve casting 13. Accordingly, there is no reason to have fluid in upper chamber 73 as no hydraulic pressure is brought to bear on piston 71 in upper chamber 73.

Once lower chamber 75 is full of fluid, a slight increase in volume will raise knob 57 a short distance allowing priming pin 109 to fall away by gravity from its position between knob 57 and top surface 111. Thereafter, valve 1 need not be further primed. Tests have shown that valve 1 is operative in any orientation and that the flow of fluid through sensing line 89 will drive air from lower chamber 75 notwithstanding the orientation of valve 1.

What is claimed is:

1. A method of valving a flow of pumped liquid, to prevent siphoning of the flow when the pump is stopped, comprising the steps of:

a) filling a chamber with liquid;

b) directing a small flow of pumped liquid into said chamber to increase its volume;

c) opening a main flow valve by said increase in chamber volume;

d) providing a leak in said chamber, into said main flow valve, to reduce the volume of liquid therein when the small flow of pumped liquid is terminated; and, e) closing said main flow valve by said decrease in chamber volume.

2. The method of claim 1 further including the step of biasing the main flow valve toward closure.

3. The method of claim 1 wherein said steps of opening and closing said main flow valve include the additional step of interconnecting said valve with a piston that moves as a function of the increase or decrease in chamber volume.

4. The method of claim 1 including the additional step of checking the small flow of pumped liquid to prevent loss thereof from said chamber when said pump is shut off.

5. The method of claim 1 wherein said steps of increasing and decreasing the chamber volume with liquid are carried out remote from the main flow of liquid.

6. An anti-syphon valve for interposition the transfer line between a liquid source and a transfer pump, comprising:

a) a valve casting and valve operational therein for controlling the flow of liquid between the liquid source and the transfer pump;

b) a first expandable chamber of liquid fed by the pump, containing a passageway into the transfer line for leaking liquid thereinto, and having an outlet the size of which is designed to allow the chamber to expand when the pump is transferring liquid through said valve casting and contracting when the pump is stopped; and, c) a controller interconnecting said chamber and said valve to open said valve when said chamber is expanded and to close said valve and terminate the liquid flow therein when said chamber is contracted by the leak of liquid therefrom.

7. The valve of claim 6 wherein said valve casting includes an inlet for connection to the liquid source and an outlet for connecting to the pump inlet.

8. The valve of claim 6 wherein said valve includes a valve seat and a valve seal movable against and away from said seat to close and open the flow path therebetween.

9. The valve of claim 6 wherein said expandable chamber includes a first chamber and a piston movably mounted therein to react to the influx of liquid therein to raise and increase the size thereof.

10. The valve of claim 6 further including an inlet into said chamber connected to the pump to receive a flow of liquid from the pump.

11. The valve of claim 10 further including a check valve in said inlet to prevent loss of liquid therefrom during periods when the pump is shut off.

12. The valve of claim 9 wherein said piston is connected to said valve seal to open said seal when said piston is moved in said cylinder by said increase in volume of the liquid.

13. The valve of claim 9 further including a path of leakage of liquid from said chamber between said piston and said valve seal.

14. The valve of claim 9 wherein said piston is sealed against leakage during movement in said chamber.

15. The valve of claim 6 including a second chamber bounded in part by said piston for contracting in volume as said first chamber is expanding.

16. The valve of claim 6 further including a moveable element for biasing said piston to close said valve when said first chamber begins to contract upon cessation of liquid flow from said pump.

17. The valve of claim 6 wherein said moveable element is a spring.

18. The valve of claim 6 wherein said controller includes a piston arranged to move in response to the expansion of said first chamber.

19. The valve of claim 18 further including a rod interconnected said piston and said valve to drive said valve in response to movement of said piston.

20. The valve of claim 6 further including a priming pin to temporarily hold said first chamber open so that initial liquid flow in said first chamber will force out air trapped therefrom to prime said valve.

21. An anti-syphon valve for interposition the transfer line between a fluid source and a transfer pump, comprising:

a) a valve casting and valve operational therein for controlling the flow of fluid between the fluid source and the transfer pump and including an inlet for connection to the fluid source and an outlet for connecting to said pump inlet and wherein said valve includes a valve seat and a valve seal moveable against and away from said seat to close and open the main flow path therebetween;

b) a first expandable chamber of fluid fed by the pump, apart from the main flow path therebetween, and having an outlet the size of which is designed to force the chamber, under fluid pressure, to expand when the pump is transferring fluid through said valve casting and contracting when the pump is stopped and, further, wherein said expandable chamber includes a first chamber and a piston movably mounted therein to react to the influx of fluid therein to increase the size thereof, wherein said piston is sealed against leakage during movement in said chamber;

c) a rod interconnecting said piston and said valve to open said valve when said chamber is expanded and to close said valve and terminate the main fluid flow therethrough when said chamber is contracted, and further including a check valve in said inlet to prevent loss of fluid therethrough during periods when the pump is shut off;

d) said casting having formed therein a bore, concentric with said rod for providing a continuous path of leakage of fluid from said chamber;

e) said casting having formed therein a second chamber bounded in part by said piston for contracting in volume as said first chamber is expanding; and, f) a moveable element for biasing said piston to close said valve when said first chamber begins to contract upon cessation of fluid flow from said pump.

* * * * *